US010183507B2

(12) United States Patent
Matsui

(10) Patent No.: US 10,183,507 B2
(45) Date of Patent: Jan. 22, 2019

(54) IMAGE RECORDING APPARATUS AND IMAGE RECORDING METHOD

(71) Applicant: BROTHER KOGYO KABUSHIKI KAISHA, Nagoya, Aichi (JP)

(72) Inventor: Yuki Matsui, Kiyosu (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/664,052

(22) Filed: Jul. 31, 2017

(65) Prior Publication Data

US 2018/0029388 A1 Feb. 1, 2018

(30) Foreign Application Priority Data

Jul. 29, 2016 (JP) ..... 2016-149910

(51) Int. Cl.

| | |
|---|---|
| ***B41J 13/00*** | (2006.01) |
| ***B41J 11/00*** | (2006.01) |
| ***B65H 3/06*** | (2006.01) |
| ***B65H 7/04*** | (2006.01) |
| ***B65H 7/06*** | (2006.01) |
| ***B65H 7/02*** | (2006.01) |

(52) U.S. Cl.

CPC ..... *B41J 13/0018* (2013.01); *B41J 11/009* (2013.01); *B41J 11/0095* (2013.01); *B65H 3/0669* (2013.01); *B65H 3/0684* (2013.01); *B65H 7/02* (2013.01); *B65H 7/04* (2013.01); *B65H 7/06* (2013.01); *B65H 2801/12* (2013.01)

(58) Field of Classification Search

CPC . B41J 13/0018; B41J 11/0095; B65H 3/0669; B65H 7/04; B65H 7/06

See application file for complete search history.

(56) References Cited

U.S. PATENT DOCUMENTS

| | | | |
|---|---|---|---|
| 5,927,703 | A | 7/1999 | Endo |
| 2007/0152396 | A1 | 7/2007 | Tanahashi et al. |

(Continued)

FOREIGN PATENT DOCUMENTS

| | | | |
|---|---|---|---|
| JP | H05-069632 | A | 3/1993 |
| JP | H09-235033 | A | 9/1997 |

(Continued)

*Primary Examiner* — Kristal Feggins
*Assistant Examiner* — Kendrick Liu
(74) *Attorney, Agent, or Firm* — Scully, Scott, Murphy & Presser, P.C.

(57) ABSTRACT

An image recording apparatus is configured such that, in response to receipt a first command designating recordation of an image on a first type sheet, a motor is driven in accordance with a first feeding condition, and in response to the first sensor not detecting the sheet until the motor rotates by a particular rotation amount, the motor is driven in accordance with a second feeding condition. Further, the controller causes the recorder to record an image, based on the first command, on the sheet which is fed as the motor is driven in accordance with the second feed condition, while, in response to the first sensor detecting the sheet before the motor rotates by the particular rotation amount, the controller does not record the image, based on the first command, on the sheet which is fed as the motor is driven in accordance with the first feeding condition.

14 Claims, 11 Drawing Sheets

(56) References Cited

U.S. PATENT DOCUMENTS

| | | | | |
|---|---|---|---|---|
| 2007/0201935 | A1* | 8/2007 | Mizutani | B41J 13/0009 400/624 |
| 2011/0310145 | A1* | 12/2011 | Samoto | B41J 11/0095 347/9 |

FOREIGN PATENT DOCUMENTS

| | | | |
|---|---|---|---|
| JP | 2007-182265 | A | 7/2007 |
| JP | 2011-093183 | A | 5/2011 |

* cited by examiner

| | MAXIMUM SPEED (ips) | ROTATION AMOUNTS (mm) |
|---|---|---|
| PLAIN SHEET FEEDING CONDITION | 9 | 15 |
| GLOSSY SHEET FEEDING CONDITION | 12 | 50 |
| GLOSSY SHEET NON-FEEDING CONDITION | 9 | 15 |

FIG. 4

IMAGE RECORDING APPARATUS AND IMAGE RECORDING METHOD

CROSS-REFERENCE TO RELATED APPLICATIONS

This application claims priority under 35 U.S.C. § 119 from Japanese Patent Application No. 2016-149910 filed on Jul. 29, 2016. The entire subject matter of the application is incorporated herein by reference.

BACKGROUND

Technical Field

The present disclosures relate to an image recording apparatus configured to record an image on a sheet, and an image recording method employed in such an image recording apparatus.

Related Art

Image recording apparatuses are generally configured to record images on various types of sheets such as plain sheets, glossy sheets and the like. Therefore, it is preferable that such an image recording apparatus has a function of detecting a type of the sheets held by a sheet feed tray. An example of such a conventional image recording apparatus is typically configured to determine a type of sheets (e.g., plain sheets, glossy sheets or the like) held by a tray based on an electrical current value flowing in a motor since the electrical current flowing in the motor varies depending on a frictional resistance between the sheet and a feeding roller driven by the motor to rotate when one of the sheets supported by the tray is fed by the feeding roller.

SUMMARY

According to above-described conventional image recording apparatus, in order to determining the type of the sheets supported by the tray, it is necessary to feed the sheet once by rotating the feeding roller. In such a configuration, since the sheet is fed merely to determine the type of the sheet, quality of the sheet may be deteriorated. In particular, when the sheet has a certain thickness or a coating is applied to the surface of the sheet, scratches may easily be formed on the surface of the sheet merely by being fed, and it is very likely that the quality of the sheets is lowered. When the sheets of which quality is lowered are re-used for image recordation, there is a possibility that sheet conveying accuracy may be lowered and/or quality of an image recorded on such a sheet is lowered.

In consideration of the above, the present disclosures provide an improved image recording apparatus which is capable of detecting a type of the sheets supported by the tray, without feeding the sheet only for determining the type thereof.

According to aspects of the disclosures, there is provided an image recording apparatus having a tray configured to support one of more sheets, a motor configured to generate a driving force, a feeding roller configured to feed the sheet held by the tray, as the driving force is transmitted from the motor, toward a conveying passage through which the sheet is fed, a first sensor configured to detect the sheet passing through the conveying passage, a recorder configured to record an image on the sheet passing through the conveying passage, and a controller. The controller is configured such that, in response to receipt a first command designating recordation of an image on a first type sheet, the controller drives the motor in accordance with a first feeding condition according to which the feeding roller cannot feed the first type sheet but can feed a second type sheet which is different from the first type sheet, while in response to the first sensor not detecting the sheet from a start of driving of the motor in accordance with the first feeding condition until the motor rotates by a particular rotation amount, the controller drives the motor in accordance with second feeding condition according to which the feeding roller can feed the first type sheet. Further, the controller causes the recorder to record an image, based on the first command, on the sheet which is fed as the motor is driven in accordance with the second feed condition. Further, in response to the first sensor detecting the sheet from the start of driving of the motor in accordance with the first feeding condition before the motor rotates by the particular rotation amount, the controller does not record the image, based on the first command, on the sheet which is fed as the motor is driven in accordance with the first feeding condition.

According to aspects of the disclosures, there is provided an image recording method employed in an image recording apparatus having a tray configured to support one of more sheets, a motor configured to generate a driving force, a feeding roller configured to feed the sheet held by the tray, as the driving force is transmitted from the motor, toward a conveying passage through which the sheet is fed a first sensor configured to detect the sheet passing through the conveying passage, a recorder configured to record an image on the sheet passing through the conveying passage. According to the method, in response to receipt a first command designating recordation of an image on a first type sheet, the motor is driven in accordance with a first feeding condition according to which the feeding roller cannot feed the first type sheet but can feed a second type sheet which is different from the first type sheet, while, in response to the first sensor not detecting the sheet from a start of driving of the motor in accordance with the first feeding condition until the motor rotates by a particular rotation amount, the motor is driven in accordance with second feeding condition according to which the feeding roller can feed the first type sheet. Further, the recorder is caused to record an image, based on the first command, on the sheet which is fed as the motor is driven in accordance with the second feed condition, and in response to the first sensor detecting the sheet from the start of driving of the motor in accordance with the first feeding condition before the motor rotates by the particular rotation amount, recordation of the image, based on the first command, on the sheet which is fed as the motor is driven in accordance with the first feeding condition is not executed.

BRIEF DESCRIPTION OF THE ACCOMPANYING DRAWINGS

FIG. 4 is a table indicating a relationship between the maximum speeds of the feeding roller and rotation amounts of the feeding roller from the rotation the feeding roller is started until the rotation speed reaches the maximum speed for respective feeding conditions.

DETAILED DESCRIPTION OF THE EMBODIMENT

Figure 1:
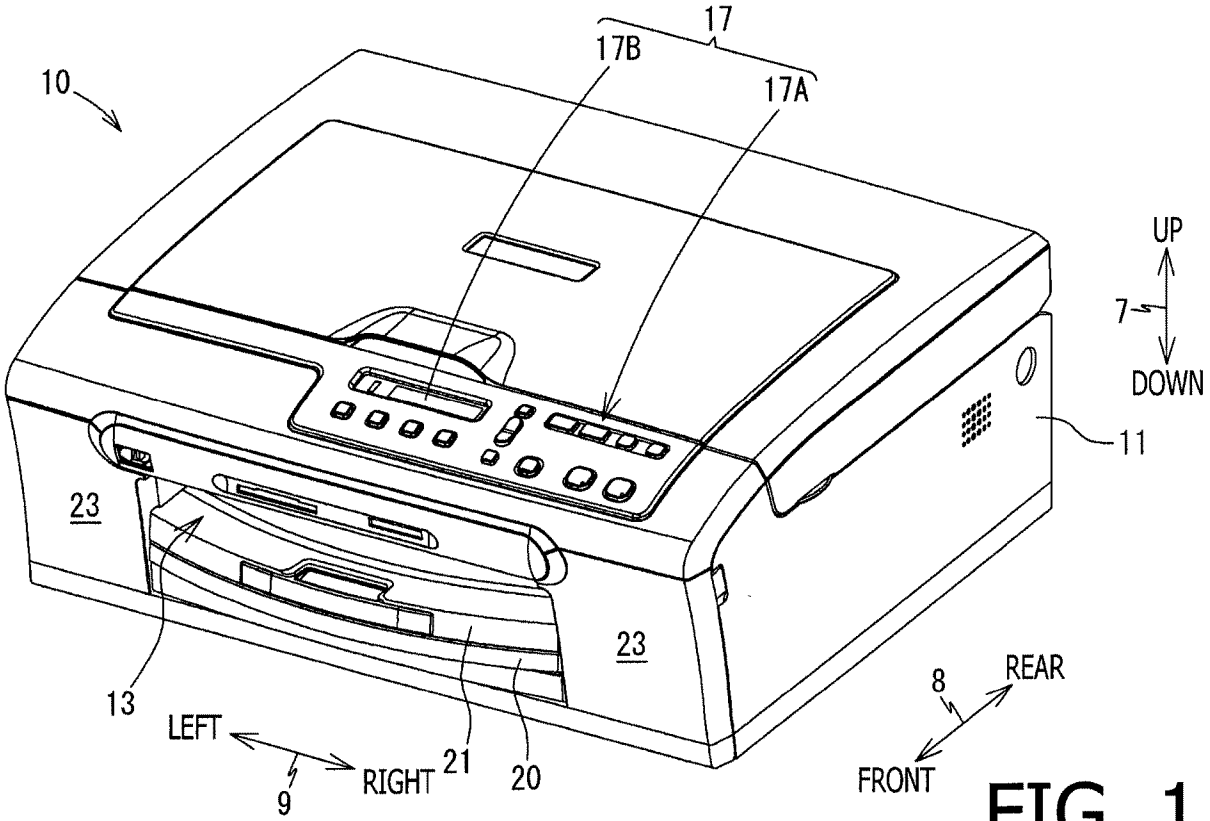
FIG. 1 is a perspective view of an MFP (multi-function peripheral) according to an illustrative embodiment of the disclosures.

Hereinafter, referring to the accompanying drawings, an illustrative embodiment according to the disclosures will be described. It should be noted that the illustrative embodiment described hereinafter is only an example of a described configuration and can be modified in various ways without departing from aspects of the disclosures. In the following description, an up-down direction 7 is defined based on a state where an MFP (multi-function peripheral) 10 is placed for use (e.g., a state shown in FIG. 1). Further, a front-rear direction 8 is defined based on a structure in which a face of the MFP 10 on which an opening 13 is formed is a front surface 23. Further, a right-left side 9 is defined when the MFP 10 is viewed from the front side. It is noted that the up-down direction 7, the front-rear direction 8 and the right-left direction 9 are orthogonal to each other.

<Overall Configuration of MFP>

As shown in FIG. 1, the MFP 10 (which is an example of an inkjet printing apparatus) has a substantially rectangular parallelepiped shape. The MFP 10 has a printer 11 in its lower part. The MFP 10 is configured to execute a plurality of functions including a facsimile function and a printing function. In particular, the MFP 10 has a printer 11 configured to print an image on one side of a sheet 12 in accordance with an inkjet printing method. The printer 11 is arranged at a lower part of the MFP 10. It is noted that the printer 11 may be configured to print images on both sides of each sheet 12. It is also noted that a method of recording images on the sheets 12 employed by the MFP 10 need not be limited to the inkjet printing method. That is, the printer 11 of the MFP 10 may be one employing an electrophotographic imaging method.

The MFP 10 has an operation panel 17 on its upper part. The operation panel 17 has an input part 17A provided with buttons and switches, and a display part 17B provided with an LCD (liquid crystal panel). Optionally, the operation panel 17 may be provided with a touch panel. In such a case, the touch panel may have functions of both the input part 17A and the display part 17B.

<Feed Tray>

As shown in FIG. 1, on a front face of the printer 11, an opening 13 is formed. A feed tray 20 (which is an example of a tray) is configured to be movable in the front-rear direction 8 so that the feed tray 20 can be inserted in the printer 11 and attached thereto, or detached from the printer 11 and withdrawn through the opening 13.

Figure 2:
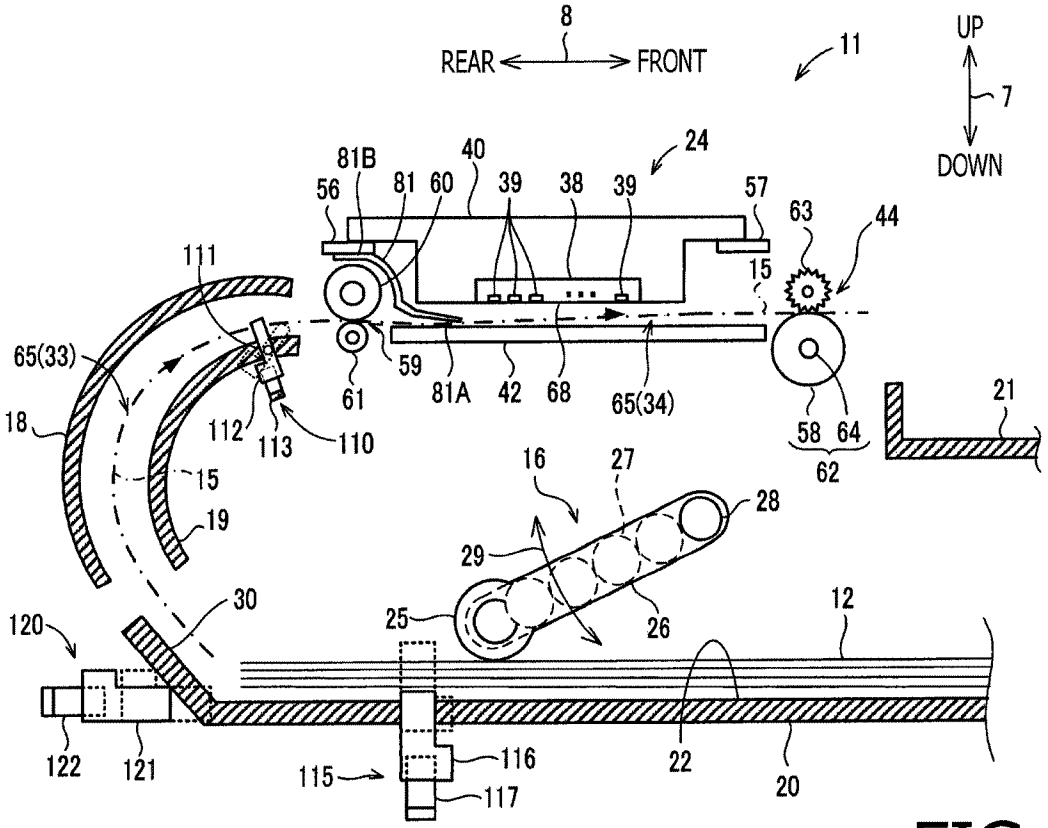
FIG. 2 is a cross-sectional view of the MFP schematically showing a structure inside the MFP shown in FIG. 1.

The feed tray 20 has a substantially rectangular-parallelepiped shape with its upper side being opened. As shown in FIG. 2, sheets (e.g., plain sheet which is an example of a second type sheet, glossy sheets which is an example of a first type sheet, OHP sheets, post cards, etc.) 12 are to be supported on a bottom plate 22 of the feed tray 20 in a stacked manner. In the following description, it is assumed that one of the plain sheets and the glossy sheets are supported by the feed tray 20 as the sheets 12. It is noted that the first type sheets may be sheets other than the glossy sheets and/or the second type sheets may be sheet other than the plain sheets.

On an upper front side of the feed tray 20, a discharge tray 21 is arranged. The sheets 12 on which image have been recorded by a recorder assembly 24, are discharged on an upper face of the discharge tray 21 and supported thereby.

The feed tray 20 is configured to be movable, with respect to the printer 11, between an attached positon and detached position.

The attached position is a position of the feed tray 20 shown in FIG. 2. When the feed tray 20 is located at the attached position, the sheets 12 supported by the feed tray 20 can be fed toward a conveying passage 65 by a sheet feeder 16 (described later).

The detached position is a position different from the attached position, or which is not the attached position. For example, the detached position is a position of the feed tray 20 when removed from the printer 11. Alternatively, the detached position may be defined as a position of the feed tray 20 when only a part thereof is inserted in the printer 11, or the feed tray 20 is located on a front side with respect to the attached position. When the feed tray 20 is located at the detached position, the sheets supported by the feed tray 20 cannot be fed toward the conveying passage 65.

<Sheet Feeder>

As shown in FIG. 2, the sheet feeder 16 is arranged below the recorder assembly 24. The sheet feeder 16 has a feeding roller 25, a feeder arm 26, a driving force transmission mechanism 27, and a shaft 28. The feeding roller 25 is rotatably supported at a distal end part of the feeder arm 26. Further, the feeder arm 26 is configured to rotate in a direction of arrow 29 about a shaft 28 provided at a proximal end part of the feeder arm 26. With this configuration, the feeding roller 25 can be moved to contact an inner bottom face of the feed tray 20 (when no sheets 12 are supported thereby) or the sheets 12 supported on the feed tray 20, or move to be spaced therefrom.

The feeding roller 25 rotates as the driving force of a feeding motor 102 (which is an example of a motor) is transmitted through the driving force transmission mechanism 27, which includes a plurality of sequentially meshed gears. With this structure, the uppermost sheet 12 which contacts the feeding roller 25 is fed toward the conveying passage 65. It is noted that the driving force transmission mechanism 27 need not be limited to the structure including the sequentially meshed gears, but, for example, a belt bridged between the shaft 28 and a rotation shaft of the feeding roller 25 may be used instead.

<Conveying Passage>

As shown in FIG. 2, the conveying passage 65 extends from a rear end part of the feed tray 20. The conveying passage 65 is a passage through which the sheet 12 is conveyed. The conveying passage 65 includes a curved passage 33 and a linear passage 34. The curved passage 33 has an arc-shaped cross-section extending upward and curving frontward. The linear passage 34 extends generally along the front-rear direction 8.

The curved passage 33 is defined by an outer guide member 18 and an inner guide member 19 which face each other with a particular clearance therebetween. Each of the guide members 18 and 19 extends in a right-left direction, which is a direction orthogonal to a plane of FIG. 2. The linear passage 34 is defined by the recorder assembly 24 and the platen 42, which face each other with a particular clearance therebetween.

The uppermost one of the sheets 12 supported by the feed tray 20 is conveyed to the curved passage 33 by the feeding roller 25, and reaches a conveying roller pair 59. The sheet 12 reached and nipped by the conveying roller pair 59 is then conveyed toward the recorder assembly 24 (i.e., frontward) through the linear passage 34. When the sheet 12 has reached immediately below the recorder assembly 24, the recorder assembly 24 records an image on the sheet 12. The sheet 12 on which the image is recorded is further conveyed frontward through the linear passage 34, and is discharged on the discharge tray 21. As above, the sheet 12 is conveyed along a conveying direction 15, which is indicated by a one-dotted line in FIG. 2.

<Recorder Assembly>

As shown in FIG. 2, the recorder assembly 24 is arranged above the linear passage 34. The recorder assembly 24 includes a carriage 40 and an inkjet head 38.

The carriage 40 is supported by two guide rails 56 and 57 which extend in the right-left direction 9 and arranged in front-rear direction 8 with a particular distance therebetween such that the carriage 40 is movable in the right-left direction 9. The guide rail 56 is arranged on an upstream side in the conveying direction 15, while the guide rail 57 is arranged on a downstream side in the conveying direction, with respect to inkjet head 38. The guide rails 56 and 57 are supported by a pair of side frames (not-shown) which are arranged outside the linear passage 34 of the conveying passage 65, respectively. The carriage 40 moves as the driving force is transmitted from the carriage driving motor 103 (see FIG. 3).

The inkjet head 38 is mounted on the carriage 40. The inkjet head 38 is of a well-known type and provided with multiple sub tanks (not shown) to which ink is supplied from multiple ink cartridges (not shown), respectively, multiple nozzles arranged on a bottom surface 68 thereof, multiple ink channels connecting respectively connecting the multiple sub tanks and the multiple nozzles 39, and multiple piezoelectric elements 45 (see FIG. 3) actuated to deform part of the ink channels so that ink droplets are ejected from the respective nozzles 39. As will be described later, the piezoelectric elements 45 operate as power is supplied from a controller 130 (see FIG. 3).

As shown in FIG. 2, at a position below the linear passage 34 and facing the inkjet head 39, a platen 53 configured to support the sheet 12, which is conveyed through the linear passage 34 of the conveying passage 65, is arranged.

As shown in FIG. 2, the platen 42 is a plate-like member of which lengths in the front-rear direction 8 and in the right-left direction 9 are longer than a length in the up-down direction 7. The platen 42 supports the sheet 12 which is being conveyed through the linear passage 34.

Figure 3:
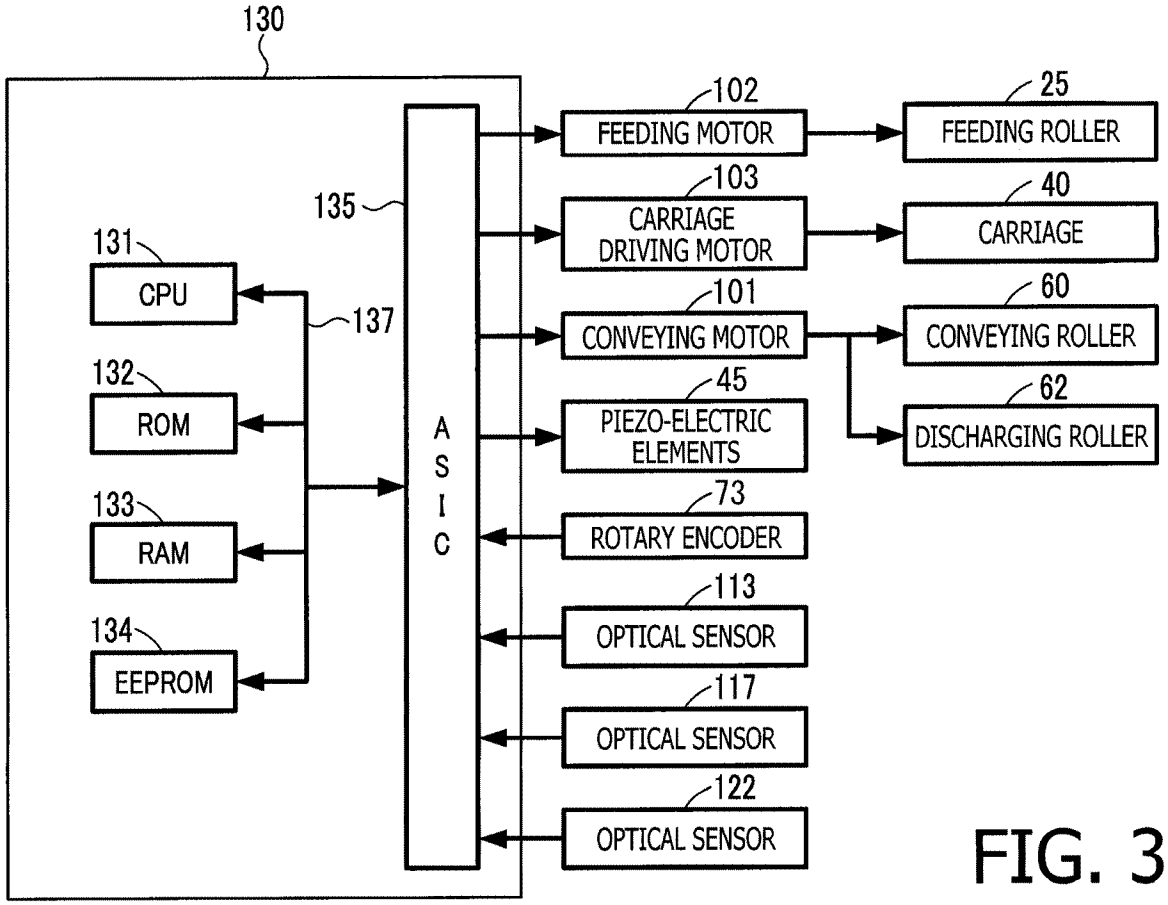
FIG. 3 is a block diagram showing a functional configuration of the MFP.

The recorder assembly 24 is controlled by the controller 130 (see FIG. 3). When the carriage 40 is moving in the right-left direction 9, the inkjet head 38 ejects the ink droplets through the nozzles 39 toward the platen 42. The ejected ink droplets impact the sheet 12 supported by the platen 42, thereby an image being recorded on the sheet 12.

<Conveying Roller Pair and Discharging Roller Pair>

As shown in FIG. 2, on an upstream side of the linear passage 34 in the conveying direction 15 with respect to the inkjet head 38, the conveying roller pair 59 is arranged. Further, on a downstream side of the linear passage 34 in the conveying direction 15 with respect to the inkjet head 38, the discharging roller pair 44 is arranged.

The conveying roller pair 59 includes a conveying roller 60 and a pinch roller 61, which is arranged below the conveying roller 60 and facing the conveying roller 60. The pinch roller 61 is urged to be press-contacted with the conveying roller 60 by an elastic member (not shown) such as a coil spring. The conveying roller pair 59 is configured to hold the sheet 12 between the conveying roller 60 and the pinch roller 61.

The discharging roller pair 44 includes a discharging roller 62 and a spur roller 63, which is arranged above the discharging roller 62 and faces the discharging roller 62. The spur roller 63 is urged to be press-contacted with the discharging roller 62 by an elastic member (not shown) such as a coil spring. The discharging roller pair 44 is configured to hold the sheet 12 between the discharging roller 62 and the spur roller 63.

The conveying roller 60 and the discharging roller 62 rotate as the driving force is supplied from a conveying motor 101 (see FIG. 3). When the conveying roller 60 rotates with the sheet 12 being held at a nip of the conveying roller pair 59, the sheet 12 is conveyed, in the conveying direction 15, to the platen 42 by the conveying roller 59. When the discharging roller 62 rotates with the sheet 12 being held at a nip of the discharging roller pair 44, the sheet 12 is conveyed, in the conveying direction 15, onto the discharge tray 21 by the discharging roller 62.

<Registration Sensor>

As shown in FIG. 2, the printer 11 is provided with a registration sensor 110. The registration sensor 110 includes a shaft 111, a detecting piece 112 and an optical sensor 113. The detecting piece 112 is configured such that an end portion thereof protrudes in the conveying passage 65 at a position on the upstream side, in the conveying direction 15, with respect to the conveying roller pair 59. In the following description, the position where the detecting piece 112 protrudes in the conveying passage 65 will be referred to as the position of the detecting piece 112. The detecting piece 112 is configured to be rotatable about the shaft 111. The optical sensor 113 includes a light emitting element and a light receiving element configured to receive light emitted by the light emitting element.

When no external force is applied to the end part of the detecting piece 112 (i.e., when the detecting pieces 112 is in a neutral state), the other end part of the detecting piece 112 enters in a light path from the light emitting element to the light receiving element of the optical sensor 113 to block the light proceeding along the light path. At this stage, a low level signal is transmitted from the optical sensor 113 to the controller 130 (see FIG. 3).

When a leading end (i.e., a downstream side end in the conveying direction 15) of the sheet 12 being conveyed and passing through the conveying passage 65 has reached the position of the detecting piece 112 and pushes the one end of the detecting piece 112, the detecting piece 112 rotates. Then, the other end of the detecting piece 112 moves away from the light path from the light emitting element to the light receiving element of the optical sensor 113, and the light receiving element receives the light emitted from the light emitting element. Then, the optical sensor 113 transmits a high level signal to the controller 130.

When a trailing end (i.e., an upstream side end in the conveying direction 15) of the sheet 12 passes over the position of the detecting piece 112, the external force applied by the sheet 12 to the detecting piece 112 is extinguished, and the other end part of the detecting piece 112 moves back to be inserted in the light path between the light emitting element and the light receiving element of the optical sensor 113, and blocks the light proceeding along the light path. Accordingly, when the trailing end of the sheet 12 passes over the position of the detecting piece 112, the optical sensor 113 transmits the low level signal again to the controller 130.

The controller 130 detects passage of the leading end (i.e., the downstream side end in the conveying direction 15) and the trailing end (i.e., the upstream side end in the conveying direction 15) of the sheet 12 based on the signal transmitted from the optical sensor 113.

Specifically, when the signal transmitted from the optical sensor 113 to the controller 130 has changed from the low level to the high level, the controller 130 determines that the leading end of the sheet 12 has passed over the position of the detecting piece 112. When the controller 130 receives the high level signal from the optical sensor 113, the controller 130 determines that the sheet 12 is present at the position of the detecting piece 112. When the signal transmitted from the optical sensor 113 to the controller 130 has changed from the high level to the low level, the controller 130 determines that the trailing end of the sheet 12 has passed over the position of the detecting piece 112. When the controller 130 receives the low level signal from the optical sensor 113, the controller 130 determines that the sheet 12 is absent at the position of the detecting piece 112. Accordingly, the controller 130 detects passage of the sheet 12 in the conveying passage 65 on the upstream side, in the conveying direction 15, with respect to the recorder assembly 24. It is noted that the registration sensor 110 and the controller 130 serve as an example of a first sensor.

It is noted that the structure and the position of the first sensor may be different from those described above as long as the first sensor can detect the sheet 12 passing through the conveying passage 65 on the upstream side, in the conveying direction 65, with respect to the recorder assembly 24.

<Sheet Sensor>

As shown in FIG. 2, a sheet sensor 115 is arranged in the vicinity of the feed tray 20 located at the attached position. The sheet sensor 115 includes a detecting piece 116 and an optical sensor 117.

The detecting piece 116 is configured to be moved in the up-down direction by the feed tray 20. Specifically, the detecting piece 116 is inserted in an opening formed on the bottom plate 22 of the feed tray 20. The detecting piece 116 is movable between an upper position at which an upper end part of the detecting piece 116 protrudes upward from the bottom plate 22 and a lower position at which the upper end part of the detecting piece 116 is located at a lower level than the level of the end part when the detecting piece is located at the upper position. It is noted that the detecting piece 116 is urged upward to be neutrally located at the upper position by an urging member (not shown) such as a coil spring.

The optical sensor 117 is arranged on the printer 11, and includes a light emitting element and a light receiving element configured to received light emitted by the light emitting element.

When no sheets 12 are supported by the feed tray 20, the detecting piece 116 is located at the upper position as is urged by the urging member. At this stage, a lower end part is located away from an optical path from the light emitting element to the light receiving element of the optical sensor 117, thereby light proceeding along the optical path and received by the light receiving element. In this case, the optical sensor 117 transmits a high level signal to the controller 130.

When the sheets 12 are supported by the feed tray 20, the detecting piece 116 is located at the lower position as is moved downward, against the urging force by the urging member, by the weight of the sheets 12. Accordingly, the lower end part of the detecting piece 116 is inserted in the light path from the light emitting element to the light receiving element of the optical sensor 117, thereby blocking the light from proceeding along the light path (i.e., the light receiving element of the optical sensor 117 does not receive the light emitted by the light emitting element). In this case, the optical sensor 117 transmits a low level signal to the controller 130.

The controller 130 detects whether the sheets 12 are present or absent on the feed tray 20 based on the signal transmitted from the optical sensor 117. Specifically, when the signal transmitted from the optical sensor 117 is the high level signal, the controller 130 determines that no sheets 12 are supported by the feed tray 20. When the signal transmitted from the optical sensor 117 is the low level signal, the controller 130 determines that the sheets 12 are supported on the feed tray 20. It is noted that the sheet sensor 117 and the controller 130 constitute an example of a second sensor.

It is noted that the structure and the position of the sheet sensor 115 may be different from those described above as long as the second sensor can detect presence/absence of the sheet 12 on the feed tray 20.

<Tray Sensor>

As shown in FIG. 2, a tray sensor 120 is arranged in the vicinity of the feed tray located at the attached position. The tray sensor 120 includes a detecting piece 121 and an optical sensor 122.

The detecting piece 121 is supported by the printer 11 so as to be movable in the front-read direction 8, between a front side position and a rear side position, at which the front end of the detecting piece 121 is located at a rearward position in comparison with a position of the front end of the detecting piece 121, when located at the front side position. The detecting piece 121 is urged by an urging member (not shown) such as a coil sprint so as to be neutrally located at the front side position.

The optical sensor 122 has a light emitting element and a light receiving element configured to receive the light emitted by the light emitting element, and an optical path being defined therebetween.

When the feed tray 20 is located at the detached position, the detecting piece 121 is located at the front side position as urged by the urging member. At this stage, a rear end part of the detecting piece 121 is moved away from the optical path from the light emitting element to the light receiving element of the optical sensor 122, and the light emitted by the light emitting element proceeds along the optical path and received by the light receiving element. In this case, the optical sensor 122 transmits a high level signal to the controller 130.

When the feed tray 20 is located at the attached position, the detecting piece 121 is moved, against the urging force of the urging member, to the rear side position as is pushed by a rear plate 30 of the feed tray 20. At this stage, the rear end part of the detecting piece 121 is inserted in the optical path from the light emitting element to the light receiving element of the optical sensor 122, and blocks the light emitted by the light emitting element and directed toward the light receiving element. In this case, the optical sensor 122 transmits a low level signal to the controller 130.

The controller 130 detects a position of the feed tray 20 based on the signal transmitted from the optical sensor 122. Specifically, when the signal transmitted from the optical sensor 122 is the high level signal, the controller 130 determines that the feed tray 20 is located at the detached position. When the signal transmitted from the optical sensor 122 is the low level signal, the controller 130 determines that the feed tray 20 is located at the attached position. Further, when the signal transmitted from the optical sensor 122 has changed from the high level signal to the low level signal, the controller 130 determines that the feed tray 20 has been moved from the detached position to the attached position. When the signal transmitted from the optical sensor 122 has changed from the low level signal to the high level signal, the controller 130 determines that the feed tray 20 has been moved from the attached position to the detached positon. It is noted that the sheet sensor 122 and the controller 130 constitute an example of a third sensor.

It is noted that the structure and the position of the tray sensor 120 may be different from those described above as long as the third sensor can detect the position of the feed tray 20, and attachment/detachment thereof.

<Rotary Encoder>

A rotary encoder 73 (see FIG. 3) is for detecting a rotation amount of the feeding motor 102. The rotary encoder 73 is of a well-known type and includes an encoder disc (not shown) which is secured to a rotation shaft of the feeding motor 102 and rotates together with the rotation shaft of the feeding motor 102, and an optical sensor (not shown). The encoder disc is formed with an encoding pattern including transparent sections and opaque sections are alternately arranged, at equal pitches, along a circumferential direction. The optical sensor is configured to detect passage of the transparent/opaque sections as the feeding motor 102 rotates. That is, when the feeding motor 102 rotates and the encoder disc rotates, the optical sensor outputs a pulse signal including pulses corresponding to passage of transparent/opaque sections. The pulse signal generated by the rotary encoder 73 is transmitted to the controller 130. The controller 130 calculates the rotation amount of the feeding motor 102 in accordance with the number of pulses of the pulse signal.

It is noted that the encoder disc of the rotary encoder 73 may be secured to a shaft other than the shaft of the feeding motor 102 as long as the rotation amount of the feeding motor can be calculated based on the pulse signal generated by the rotary encoder 73. For example, the encoder disc may be secured to the shaft of the feeding roller 25.

<Controller>

Figure 6A:
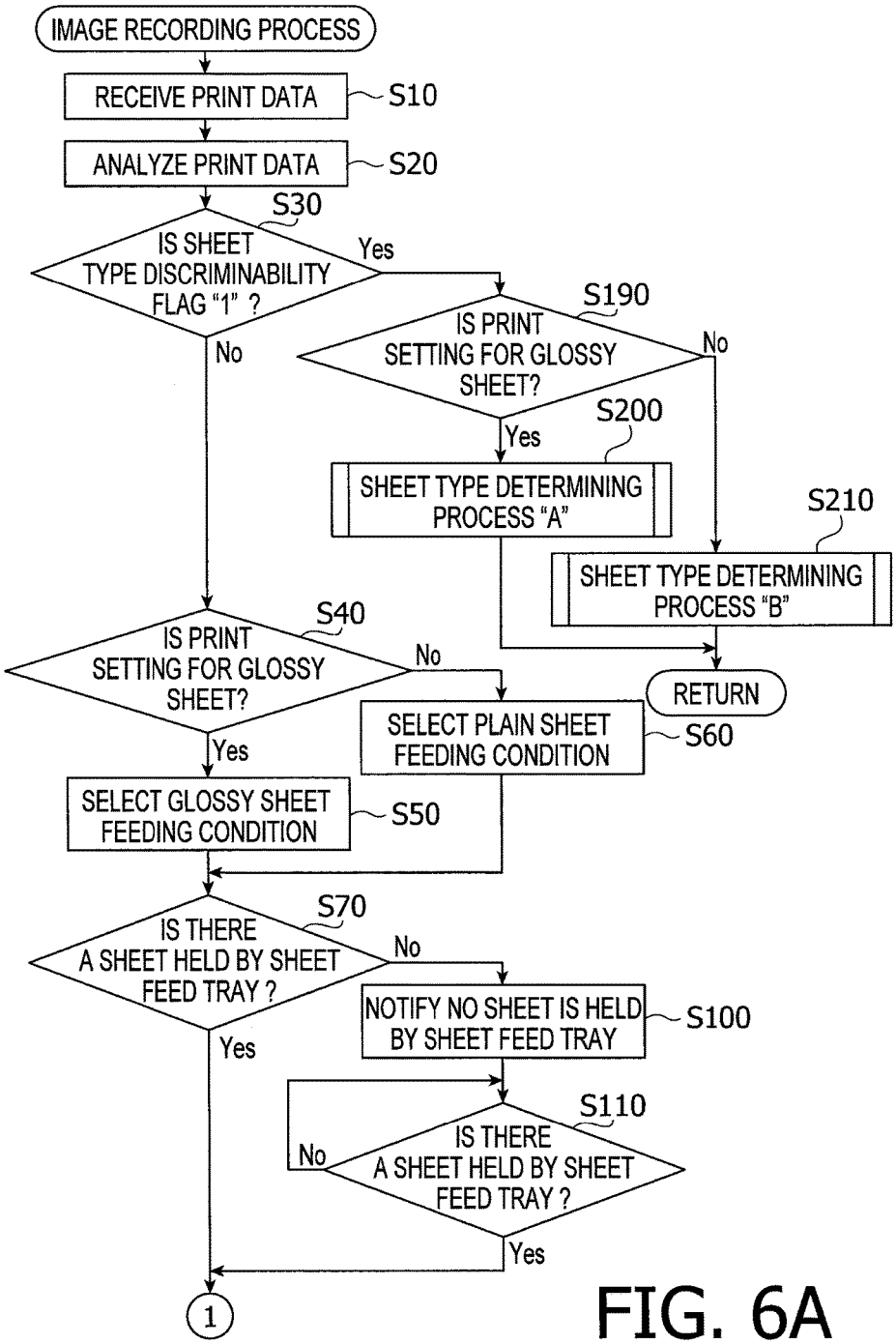
FIGS. 6A and 6B show a flowchart illustrating an image recording process according to the illustrative embodiment of the disclosures.
Figure 6B:
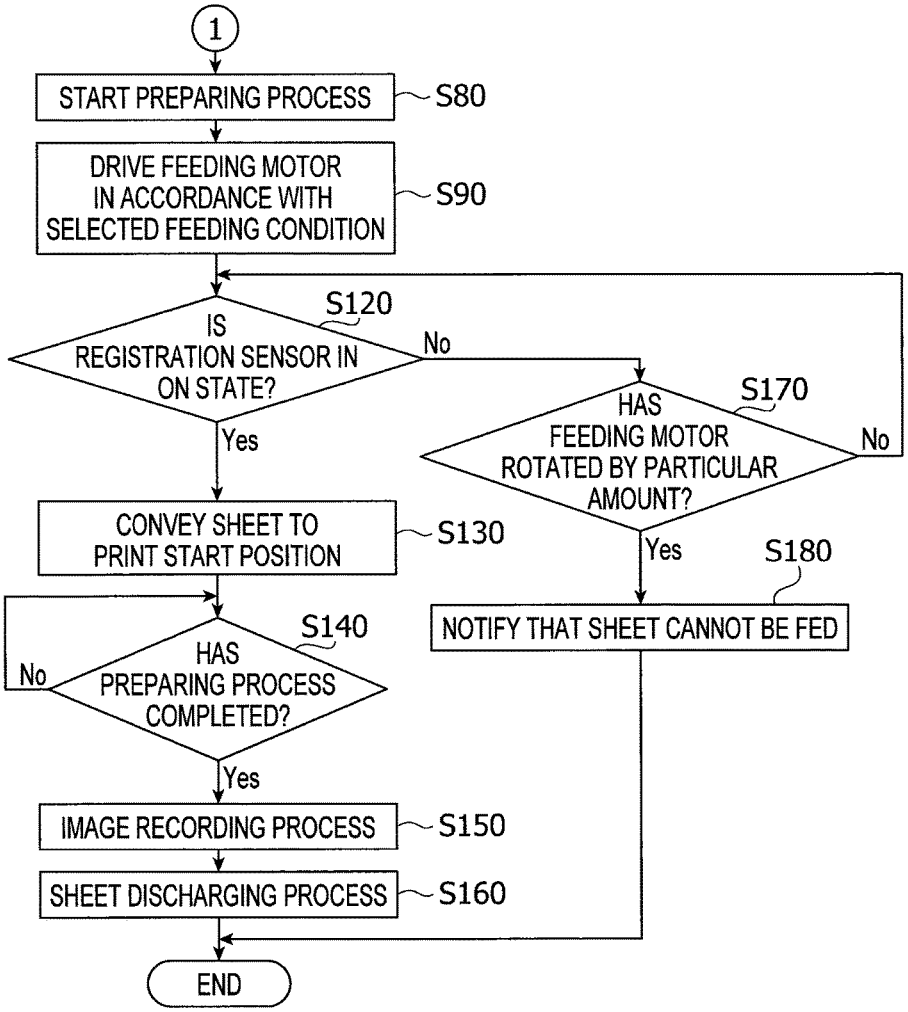

The controller 130 controls an entire operation of the MFP 10. It is noted that the controller 130 executes an image recording process shown in FIGS. 6A and 6B, and sheet type determining processes shown in FIGS. 7A, 7B, 8A and 8B. The controller 130 includes a CPU (central processing unit) 131, a ROM (read only memory) 132, a RAM (random access memory) 133, an EEPROM (electrically erasable ROM) 134, an ASIC (application specific integrated circuit) 135, which are interconnected through an inner bus 137.

The ROM 132 stores programs which realize, when executed by the CPU 131, various operations of the MFP 10 including the image recording process and the sheet type determining processes mentioned above. The RAM 133 is used as a storage area for temporarily storing data, signals and the like which are used when the CPU 131 executes the programs mentioned above. The EEPROM 134 stored settings and flags which should be retained after the MFP 10 is powered off.

A sheet type discriminability flag is stored in the RAM 133 or the EEPROM 134. The sheet type discriminability flag is set to "1" (True) when, whether the type of the sheets 12 held by the feed tray 20 is plain sheets or glossy sheets, is indefinite (unknown), while the sheet type discriminability flag is set to "0" (False) when, whether the type of the sheets 12 held by the feed tray 20 is plain sheets or glossy sheets, is definite.

The sheet type discriminability flag is set to "1" when the power of the MFP 10 has been switched from "OFF" to "ON". There is a possibility that the sheets 12 held by the feed tray 20 may have been replaced while the MFP 10 is in a powered off state. Therefore, when the MFP 10 has been powered on, it is unknown whether the type of the sheets 12 held by the feed tray 20 is the plain sheets or the glossy sheets. Therefore, the sheet type discriminability flag is set to "1" in this case.

Further, the sheet type discriminability flag is set to "1" when the feed tray 20 has been moved from the detached position to the attached position. There is a possibility that the sheets 12 held by the feed tray 20 may have been replaced when the feed tray 20 is moved to the detached position. Therefore, when the feed tray 20 has been moved from the detached position to the attached position, it is unknown whether the type of the sheets 12 held by the feed tray 20 is the plain sheets or the glossy sheets. Therefore, the sheet type discriminability flag is set to "1" in this case.

Figure 7A:
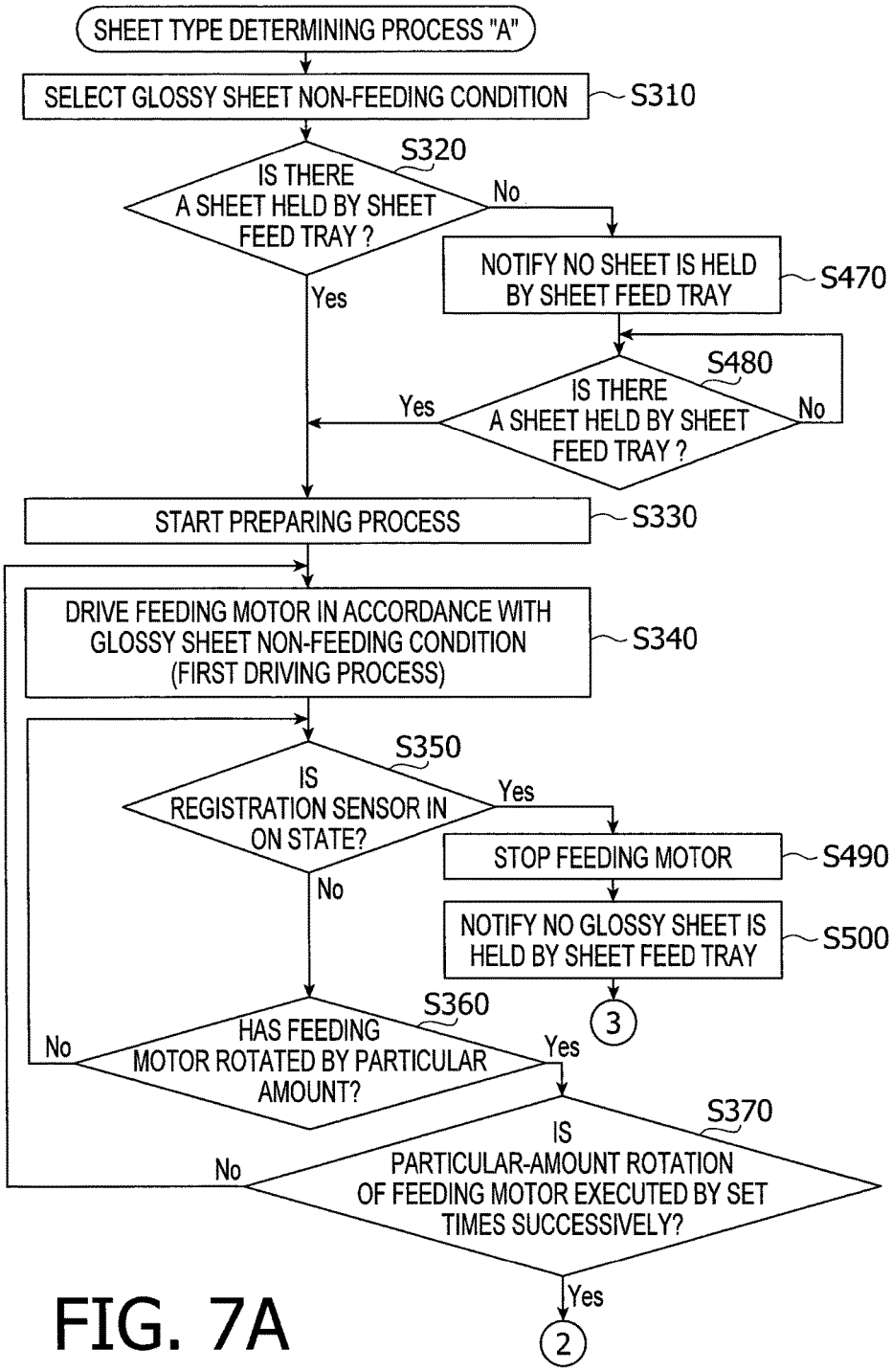
FIGS. 7A and 7B show a flowchart illustrating a sheet type determining process "A" when a glossy sheet is set, according to the illustrative embodiment of the disclosures.
Figure 7B:
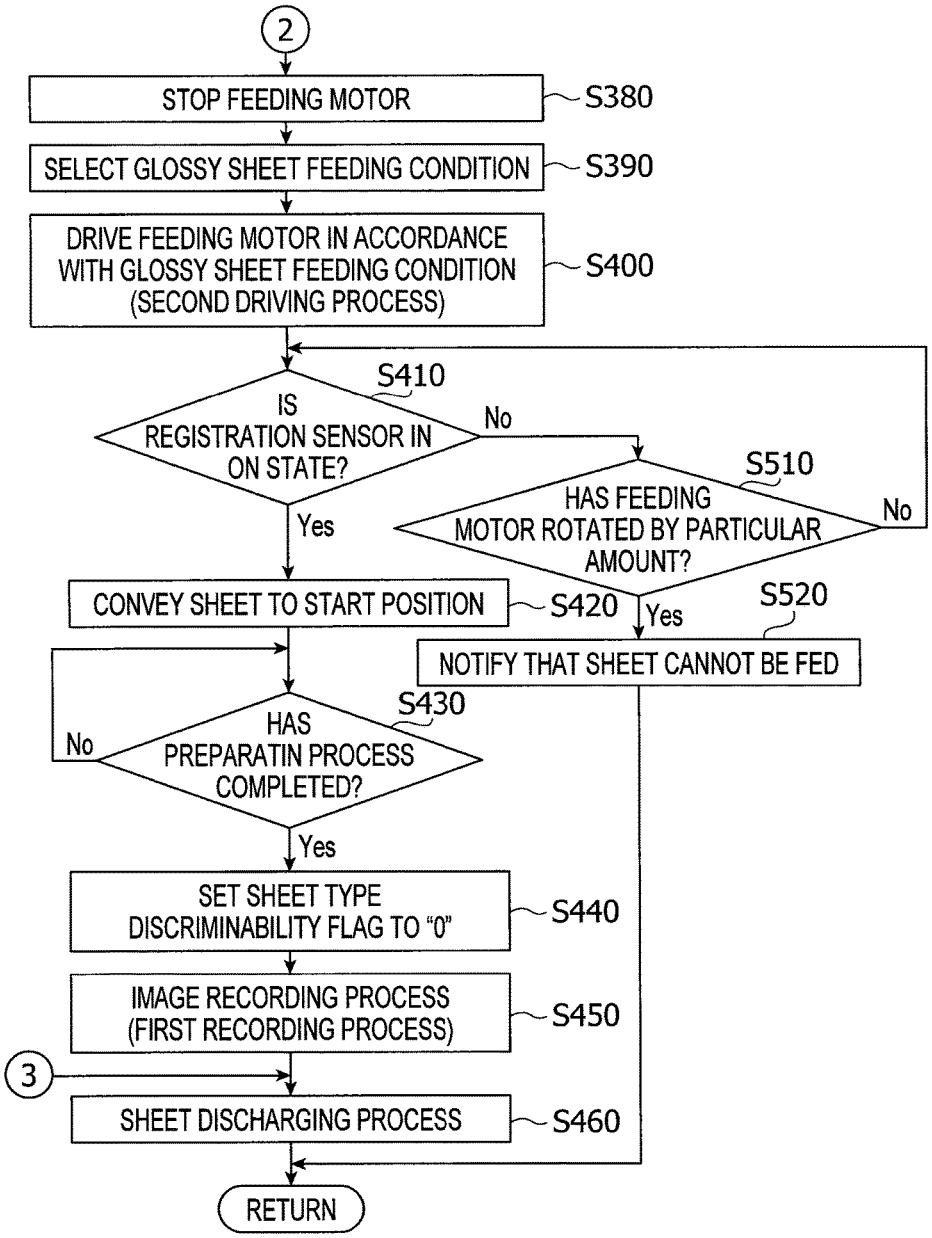
Figure 8A:
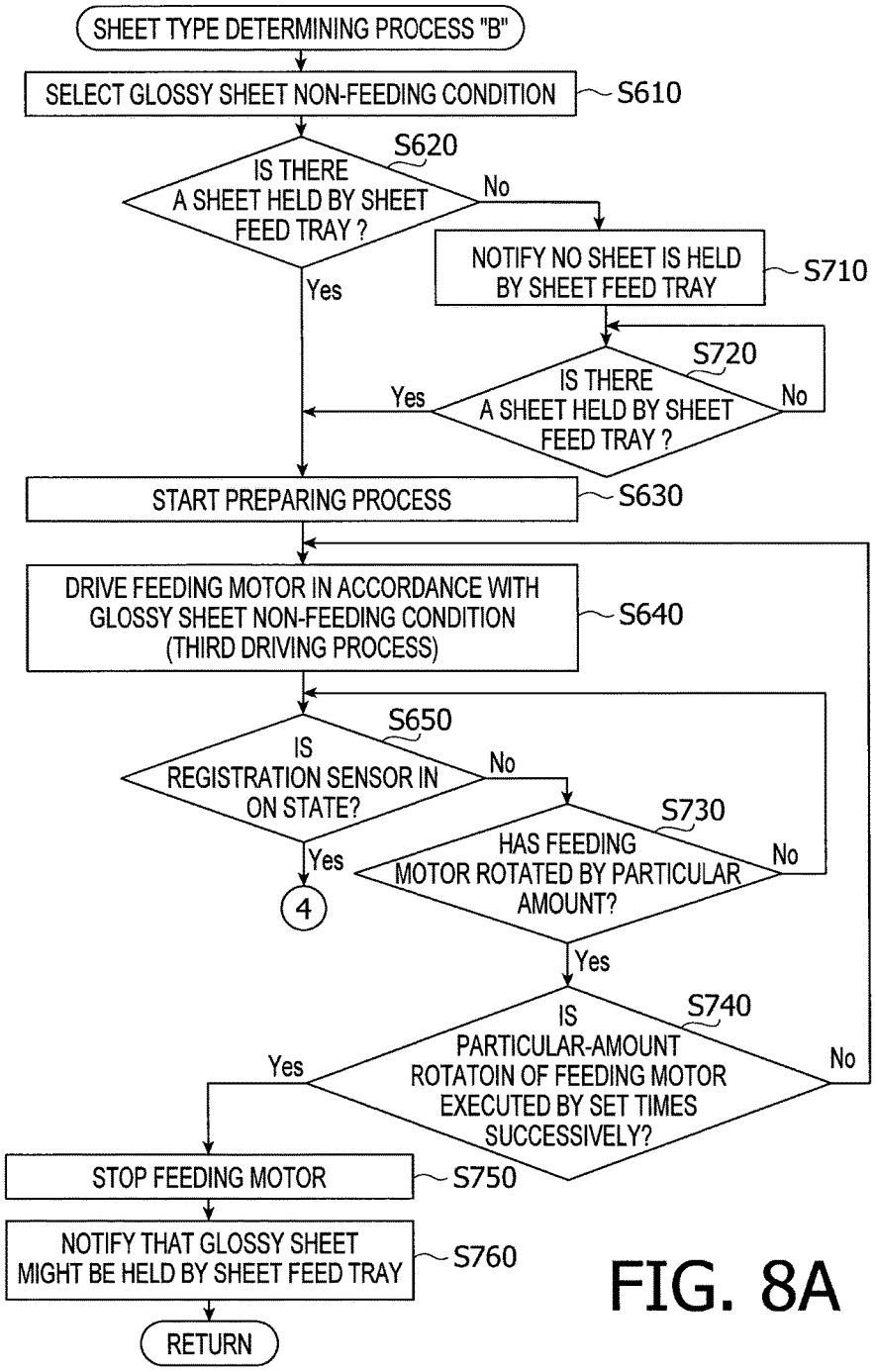
FIGS. 8A and 8B show a flowchart illustrating a sheet type determining process "B" when a plain sheet is set, according to the illustrative embodiment of the disclosures.
Figure 8B:
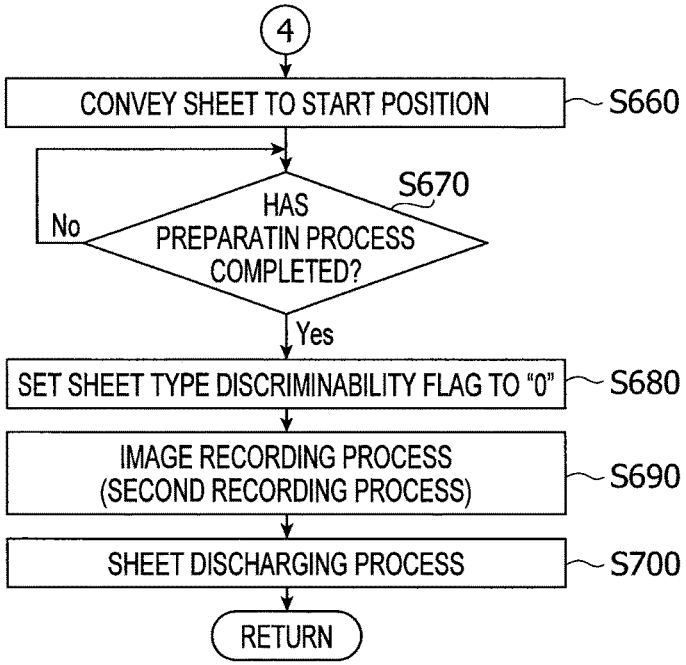

It is noted that the sheet type discriminability flag is set to "0" when the sheet 12 is fed out of the feed tray 20 and detected by the registration sensor 110 in the sheet type determining process (e.g., S440 of FIG. 7B, S680 of FIG. 8B). It is because, as the sheet type determining process is executed, it becomes definite that which of the plain sheets or the glossy sheets are held by the feed tray 20.

It should be noted that, as mentioned above, the controller 130 determines that the feed tray 20 has been moved from the detached position to the attached position when the signal transmitted from the optical sensor 122 of the tray sensor 120 has changed from the high level signal to the low level signal.

A feeding condition is stored in the ROM 132 or the EEPROM 134. The feeding condition represents a condition when the feeding roller 25 feeds the sheet 12, and includes a maximum speed, an acceleration, an acceleration time of the rotation of the feeding roller 25 and the like. According to the illustrative embodiment, the feeding condition includes the maximum rotation speed and a rotation amount of the feeding roller 25. It is noted that the rotation amount represents an amount of rotation of the feeding roller 25 after the feeding roller 25 starts rotating until the rotation speed reaches the maximum rotation speed. In other words, the rotation amount of the feed roller 25 represents a distance that the sheet 12 advances after the feeding roller 25 starts rotating until the rotation speed reaches the maximum speed. It is noted that the acceleration and the acceleration time can be calculated based on the maximum speed and the rotation amount. Further, according to the illustrative embodiment, the feeding roller 25 is controlled such that the rotation is started and accelerated to reach the maximum speed, then, the feeding roller 25 is driven to keep rotating at a constant speed, and thereafter, the rotation speed is decelerated and stopped.

It is noted that the feeding condition is set for each of the types of the sheets 12. According to the illustrative embodiment, three conditions, namely, a plain sheet feeding condition, a glossy sheet feeding condition, which is an example of a second feeding condition), and a glossy sheet non-feeding condition, which is an example of a first feeding condition are stored in the ROM 132 or the EEPROM 134. It is noted that, according to the illustrative embodiment, feeding of the sheet 12 by the feeding roller 25 to make the sheet 12 reach the position where the registration sensor 110 is arranged will be defined as "feeding". Therefore, a feeding condition according to which the glossy sheet 12 does not reach the position of the registration sensor 110 will be referred to as a glossy sheet non-feeding condition. Further, the feeding condition according to which the plain sheet 12 reaches at least the position of the registration sensor 110 is the plain sheet feeding condition, and the feeding condition according to which the glossy sheet 12 reaches at least the position of the registration sensor 110 is the glossy sheet feeding condition.

The plain sheet feeding condition is a condition according to which the feeding roller 25 can feed the plain sheet 12. The glossy sheet feeding condition is a condition according to which the feeding roller 25 can feed the glossy sheet 12. In contrast, the glossy sheet non-feeding condition is a condition according to which the feeding roller 25 cannot feed the glossy sheet, but can feed the plain sheet.

According to the illustrative embodiment, the rotation amount in the glossy sheet non-feeding condition (which is an example of a first rotation amount) is smaller than the rotation amount in the glossy sheet feeding condition (which is an example of a second rotation amount). Further, the maximum speed in the glossy sheet non-feeding condition (which is an example of a first rotation speed) is smaller than the maximum speed in the glossy sheet feeding condition (which is an example of a second rotation speed).

As shown in FIG. 4, the maximum speed in the plain sheet feeding condition according to the illustrative embodiment is 9 (ips: inch per second), and the rotation amount in the plain sheet feeding condition is 15 (mm). The maximum speed in the glossy sheet feeding condition according to the illustrative embodiment is 12 (ips), and the rotation amount in the glossy sheet feeding condition is 50 (mm). Further, the maximum speed in the glossy sheet non-feeding condition according to the illustrative embodiment is 9 (ips), and the rotation amount in the glossy sheet non-feeding condition is 15 (mm). That is, according to the illustrative embodiment, the glossy sheet non-feeding condition is identical to the plain sheet feeding condition. It should be noted that the glossy sheet non-feeding condition may be different from the plain sheet feeding condition. Further, the maximum speed and the rotation amount in each of the conditions shown in FIG. 4 are only examples and need not be limited to the values as indicted. It is, however, noted that since stiffness of the glossy sheet is relatively strong, the maximum speed for feeding the glossy sheet is greater than the maximum speed for feeding the plain sheet so that the glossy sheet can be fed through the curved passage 33 of the conveying passage 65 without fail.

Figure 5:
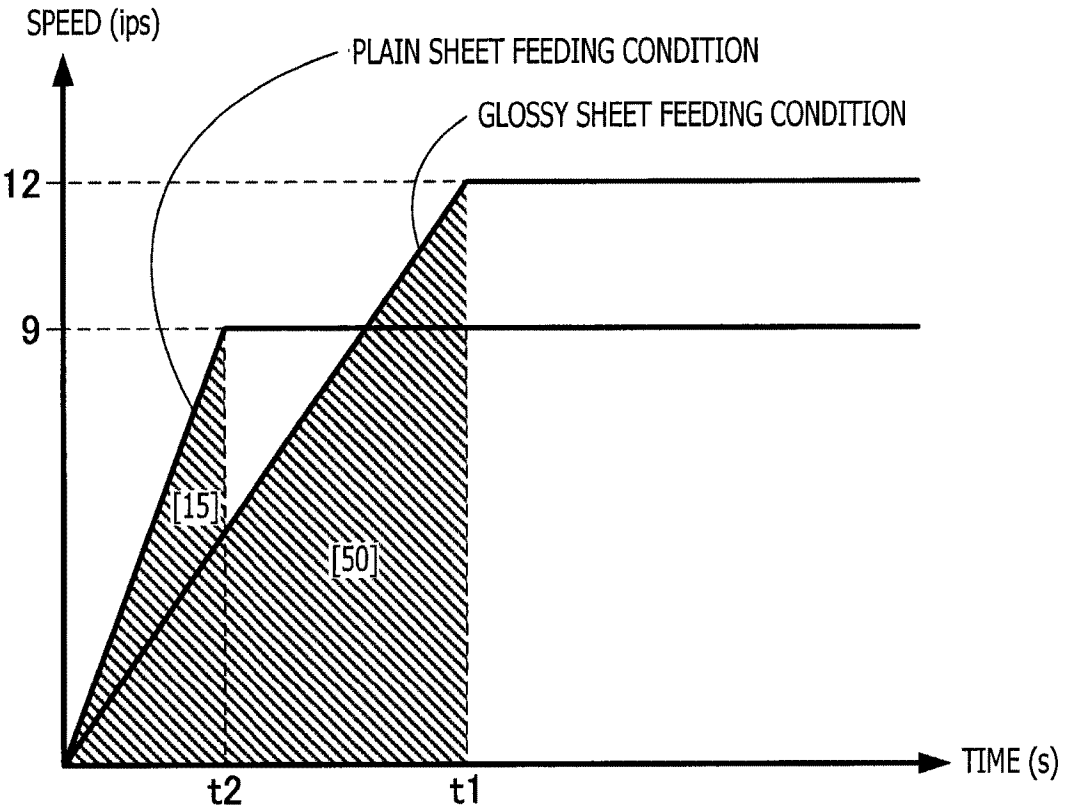
FIG. 5 is a graph showing a relationship between an elapsed time after start of rotation of the feeding roller and the rotation speed thereof.

FIG. 5 shows two graphs each indicating an elapsed time (unit: second) from a time when the feeding roller 25 starts rotating in a horizontal axis, and a speed (unit: inches per second) of the feeding roller 25. It is noted that inclinations of the two graphs represent accelerations (unit: $ips^2$) of the feeding roller 25, and areas S of hatched portions represent rotation speeds (unit: mm) of the feeding roller 25 in the plain sheet feeding condition and the glossy sheet feeding condition, respectively. Therefore, an acceleration time t for each condition can be calculated by solving a equation:

$$(t \times V)/2 = S,$$

where, V is the maximum speed, and S is the rotation amount.

Further, an acceleration can be calculates as V/t. That is, the accelerations are represented by the inclinations of the two graphs.

According to the illustrative embodiment, the acceleration time is longer ant the acceleration is smaller in the glossy sheet feeding condition than in the plain sheet feeding condition (the glossy sheet non-feeding condition). According to the illustrative embodiment, as shown in FIG. 5, the acceleration time t1 in the glossy sheet feeding condition as longer than the acceleration time t2 in the plain sheet feeding condition. Further, the inclination of the graph in the glossy sheet feeding condition is gentler than the inclination of the graph in the plain sheet feeding condition. That is, the acceleration in the glossy sheet feeding condition is smaller than the acceleration in the plain sheet feeding condition.

The ASIC 135 is connected with the conveying motor 101, the feeding motor 102 and the carriage driving motor 103. In the ASIC 135, driving circuits configured to control respective motors are implemented. When the CPU 131 inputs a driving signal to rotate one of the motors into the driving circuit corresponding to the motor to be rotated, a driving current corresponding to the driving signal is transmitted to the corresponding motor, thereby the corresponding motor rotating. That is, the controller 130 controls each of the motors 101, 102 and 103.

Further, the ASIC 135 is configured to receive the pulse signal output by the optical sensor of the rotary encode 73. The controller 130 calculates the rotation amount of the feeding motor 102 based on the pulse signal transmitted from the optical sensor of the rotary encoder 73.

The ASIC 135 is further connected with the optical sensor 113 of the registration sensor 110, the optical sensor 117 of the sheet sensor 115, and the optical sensor 122 of the tray sensor 120. As mentioned above, the controller 130 detects the sheet 12 passing through the conveying passage 65 based on the signal transmitted from the optical sensor 113, presence/absence of the sheets 12 held by the feed tray 20 based on the signal transmitted from the optical sensor 117, and detects the position of the feet tray 20 based on the signal transmitted from the optical sensor 122.

Further, the piezoelectric elements 45 are connected to the ASIC 135. The piezoelectric elements 45 operate as a power is supplied from the controller 130 through a driving circuit (not shown). The controller 130 controls power supply to the piezoelectric elements so that the ink droplets are selectively ejected from the multiple nozzles 39.

<Image Recording Process>

The printer 11 configured as described above is controlled to executes an image recording process to record an image on the sheet 12 conveyed therein under control of the controller 130. The image recording process will be described in detail referring to a flowchart shown in FIGS. 6A and 6B.

When the controller 130 receives print data generated by the facsimile function, the scanner function thereof, or transmitted from an external device connected with the MFP 10 (S10), the controller 130 analyzes the print data (S20).

The print data includes a print setting. The print setting is a command designating a type, a size and the number of the sheets 12 on which images are to be recorded. According to the illustrative embodiment, a command specifying the glossy sheets on which images are to be recorded is defined as a first command, while a command specifying the plain sheets on which images are to be recorded is defined as a second command. In S20, the controller 130 analyzes the print setting included in the print data, and identifies the type, size and the number of the sheets 12 on which images are to be recorded.

Next, the controller 130 refers to the sheet type discriminability flag stored in the RAM 133 or the EEPROM 134

(S30). When the sheet type discriminability flag is "0" (S30: NO), the controller 130 executes a process from S40-S180, which is a process when the type of the sheets 12 held by the feed tray 20 is definite (i.e., it is known whether the plain sheets or glossy sheets are held by the feed tray 20).

When the sheet type discriminability flag is "1" (S30: YES), that is, when the image recording process is executed first time after power supply to the MFP 10 has been switched from off to on, or the feed tray 20 has been moved from the detached position to the attached position, the controller 130 executes a process from S190-S210 as a process to be executed when the type of the sheets 12 held by the feed tray 20 has not been identified. It is noted that a process in S200 is detailed in a flowchart shown in FIGS. 7A and 7B, and a process in S210 is detailed in a flowchart shown in FIGS. 8A and 8B.

When the sheet type discriminability flag is "0" (S30: NO), the controller 130 determines whether image recordation onto glossy sheets is designated in the print setting that is analyzed in S20, in other words, whether the print setting is the first command (S40). When image recordation onto the glossy sheets is designated in the print setting (S40: YES), the controller 130 selects the glossy sheet feeding condition from among the multiple feeding conditions stored in the ROM 132 or the EEPROM 134 (S50). When it is determined that recordation onto the plain sheets is designated in the print setting (S40: NO), the controller 130 selects the plain sheet feeding condition from among the multiple feeding conditions (S60).

Next, the controller 130 determines whether the sheets 12 are held by the feed tray (S70) based on the signal transmitted from the optical sensor 117 of the sheet sensor 115.

When it is determined that the sheets 12 are held by the feed tray 20 (S70: YES), the controller 130 starts a preparing process (S80), and drives the feeing motor 102 (S90) such that the feeding roller 25 rotates in accordance with the feeding condition selected in S40-S60. It is noted that a driving condition of the feeding motor 102 corresponding to the selected feeding condition could generally be derived based on, for example, a reduction ratio of a transmission mechanism from the feeding motor 102 to the feeding roller 25. Therefore, once a feeding condition is selected, an appropriate driving condition of the feeding motor 102 to satisfy the selected feeding condition can be determined.

When it is determined that the no sheet 12 is held by the feed tray 20 (S70: NO), the controller 130 notifies that no sheet 12 is held by the sheet feed tray 20 (S100). Notification is made by, for example, displaying information indicating that no sheet 12 is held by the sheet feed tray 20 on the display part 17B of the operation panel 17.

Thereafter, when the signal transmitted from the optical sensor 117 is switched from the high level to the low level, it is determined that the sheets 12 are supported by the sheet feed tray 20 (S110: YES), steps S80 and S90 described above.

The preparing process executed in S80 is a process executed to prepare for image recordation on the sheets 12. The preparing process includes, for example, a cleaning process including flushing or purging to be applied to the recorder assembly 24, a de-capping process to move a cap covering a nozzle surface, which is a surface of the inkjet head 38 formed with a plurality of nozzles 39, away from the recording assembly 24, a drive switching process, a sheet detection process and the like.

Flushing is idle discharging of the ink droplets from the inkjet head 38. Purging is an operation to suck the ink and the air inside the nozzles, and foreign substances adhered on the nozzle surface. The drive switching process is a process to switch destinations of a driving force. For example, when the driving force of the feeding motor 102 is to be selectively transmitted to one of the feeding roller 25 and a pump that is used to suck the ink, switching between the feeding roller 25 and the pump is executed in the drive switching process. The sheet detection process is a process, for example, to move the carriage 40 provided with a sheet detection sensor in the right-left direction 9 to detect absence/presence of the sheet 12 facing the carriage 40 in the conveying passage 65.

The preparing process is executed in parallel with processes of S90-S130.

When the feeding motor 102 is driven in S90, the feeding roller 25 rotates. Thereafter, the controller 130 determines whether the state of the registration sensor 110 is switched from the off state to the on state, that is, whether the signal transmitted from the optical sensor 113 of the registration sensor 110 is changed from the low level signal to the high level signal (S120).

When the state of the registration sensor 110 has changed from the off state to the on state (S120: YES), the controller 130 determines that the sheet 12 has been fed to the positon of the registration sensor 110 by the feeding roller 25. Thereafter, the controller 130 conveys the sheet 12 to the print start position (S130). Specifically, the controller 130 drives the conveying motor 101 to cause the conveying roller 60 to convey the sheet 12, which has reached the conveying roller pair 59, in the conveying direction 15. It is noted that the print start position is defined as a position of the sheet 12 when a downstream end, in the conveying direction 15, of an image recording area of the sheet 12 faces the nozzles 39 arranged at the most downstream side, in the conveying direction 15, among the plurality of nozzles 39.

Thereafter, the controller 130 waits for completion of the preparing process that is started in S80 (S140: NO). When the preparing process has completed (S140: YES), the controller 130 executes the image recording process (S150) based on the print data received in S10 and the print setting included in the print data.

In S150, the controller 130 executes an intermittent conveying process to cause the conveying roller pair 59 and the discharging roller pair 44 to alternately execute conveyance of the sheet 12 by a particular line feed amount and stoppage of the sheet 12. Further, the controller 130 controls the carriage driving motor 103 to move the carriage 40 in the right-left direction 9 when the sheet 12 stops during the intermittent conveying process. Furthermore, the controller 130 controls power supply to the piezoelectric elements 45 during movement of the carriage 40 to cause the plurality of nozzles 39 to selectively ejects the ink droplets, thereby an image being recorded on the sheet 12.

After completion of the image recording process in S150, the controller 130 executes a sheet discharging process, in which the controller 130 controls the conveying motor 101 to cause the discharging roller pair 44 to discharge the sheet 12 onto the discharge tray 21 (S160).

When it is detected that the state of the registration sensor 110 is not changed from the OFF state to the ON state (S120: NO), the controller 130 determines whether the feeding motor 102 has rotated by a particular amount based on the pulse signal transmitted from the rotary encoder 73 (S170). The particular amount is an amount determined by adding a constant rotation amount in order to ensure that the sheet 12 reaches the registration sensor 110 to the rotation amount corresponding to the feeding distance of the sheet 12 from the feed tray 20 to the registration sensor 110.

When the feeding motor 102 has rotated by the particular amount (S170: YES) before the state of the registration sensor 110 changes from the OFF state to the ON state (S120: NO), the controller 130 stops the feeding motor 102, and notifies that the sheet 12 cannot be fed (S180).

When the sheet type discriminability flag is "1" (S30: YES), the controller 130 determines whether the image recordation onto the glossy sheet is designated in the print setting analyzed in S20, that is, whether the print setting is the first command (S190). When the image recordation onto the glossy sheet is designated in the print setting (S190: YES), the controller 130 executes a sheet type determining process "A" (described later) in S200. When the image recordation onto the plain sheet is designated in the print setting (S190: NO), the controller 130 executes a sheet type determining process "B" (described later) in S210.

<Sheet Type Determining Process "A">

Hereinafter, referring to FIGS. 7A and 7B, the sheet type determining process "A" will be described. It is noted that the sheet type determining process "A" is a sheet type determining process to be executed when the glossy sheet is set to be the recording sheet in the print setting.

When it is determined that recordation on the glossy sheet is designated in the print setting, that is, when the controller 130 receives the first command (S190: YES), the controller 130 selects the glossy sheet non-feeding condition (S310) from among multiple feeding conditions stored in the ROM 132 or the EEPROM 134.

Next, the controller 130 detects whether the sheets 12 are held by the feed tray 20 based on the signal transmitted from the optical sensor 117 of the sheet sensor 115 (S320).

When it is determined that the sheets 12 are held by the feed tray 20 (S320: YES), the controller 130 starts the preparing process (S330), and drives the feeding motor 102 (S340) so that the feeding roller 25 rotates in accordance with the glossy sheet non-feeding condition. It is noted that the preparing process is executed in parallel with the process in S340-S420.

When it is determined that no sheet 12 is held by the feed tray 20 (S320: NO), the controller 130 notifies that no sheet is held by the feed tray 20 (S470). Thereafter, when it is determined that the sheets 12 are held by the feed tray 20 (S480: YES), the controller 130 executes S330 and S340 described above.

When the feeding motor 102 is driven in S340, the feeding roller 25 rotates. Thereafter, the controller 130 determines, as is done in S120, whether the state of the registration sensor 110 has changed from the off state to the on state (S350).

When it is determined that the state of the registration sensor 110 has changed from the off sate (S350: YES) to the on state before the feeding motor 102 rotate by the particular amount (S360: NO), the controller 130 determines that the sheet 12 as fed is not the glossy sheet (i.e., the sheet 12 is the glossy sheet). In this case, the controller 130 stores information representing that the sheets 12 held by the feed tray 20 are the plain sheets in the EEPROM 134 or the RAM 133. Further, the controller 130 stops the feeding motor 102 (S490), notifies that the glossy sheets are not held by the feed tray 20 (S500), discharges the sheet 12 which has been fed (S460), and terminates the sheet type determining process "A". Thus, when the state of the registration sensor 110 has changed from the off state to the on state (S350: YES) before the feeding motor 102 rotates by the particular amount (S360: NO), image recordation on the sheets 12 held by the feed tray 20 is not executed. It is noted that the process in S500 is an example of a notifying process.

According to the illustrative embodiment, the controller 130 is configured to discharge the sheet 12 as fed (S460) after execution of S500, and terminate the sheet type determining process "A". However, this process may be modified such that whether the sheet 12 as fed is discharged or not is designated by the user. In such a modification, if the user wishes recordation of the image on the fed sheet 12, the user can select recordation of the image on the currently fed sheet 12 without discharging the same. In this case, it becomes possible to continue recordation of the image by changing the print condition to meet the plain sheet. When the user does not wish recordation of the image on the currently fed sheet 12, the user can select discharging of the sheet 12.

When the feeding motor 102 has rotated by the particular amount (S360: YES) while the registration sensor 110 is kept in the off state (S350: NO), the controller 130 determines whether the particular-amount rotation of the feeding motor 102 by the particular amount have been successively executed by a particular set times (S370).

When it is determined that the particular-amount rotation of the feeding motor 102 has not been executed by the particular set times successively (S370: NO), the controller 130 drives the feeding motor 102 in accordance with the glossy sheet non-feeding condition again (S340), and determines whether the state of the registration sensor 110 changes from the off state to the on state before the feeding motor 102 rotates by the particular rotation amount.

When it is determined that the particular-amount rotation of the feeding motor 102 has been executed by the particular set times successively (S370: YES) while the registration sensor 110 stays in the off state (S350: NO), the controller 130 determines that the sheets 12 set in the feed tray 20 are the glossy sheets. In such a case, the controller 130 stores information indicating that the sheets 12 held by the feed tray 20 are the glossy sheets in the EEPROM 134 or the RAM 133. Further, in such a case, the controller 130 stops the feeding motor 102 (S380).

According to the illustrative embodiment, when the particular-amount rotation of the feeding motor 102 is executed by particular set times successively while the state of the registration sensor 110 does not change from the off state to the on state, the controller 130 determines that the sheets 12 set in the feed tray 20 are the glossy sheets. The above configuration may be modified such that, when the particular-amount rotation of the feeding motor 102 is executed once, the controller 130 determines that the sheets 12 set in the feed tray 20 are the glossy sheets.

Next, the controller 130 selects the glossy sheet feeding condition (S390) from among the multiple feeding conditions stored in the ROM 132 or the EEPROM 134, and drives the feeding motor 102 in accordance with the glossy sheet feeding condition (S400). It is noted that the process in S400 is an example of a second driving process.

When the feeding motor 102 is driven in S400, the feeding roller 25 rotates. Thereafter, the controller 130 determines whether the state of the registration sensor 110 is changed from the off state to the on state (S410) as in S350.

When it is determined that the state of the registration sensor 110 has changed from the off state to the on state (S410: YES), the controller 130 determines that the sheet 12 (the glossy sheet) has been fed to the position of the registration sensor 110. Thereafter, the controller 130 conveys the sheet 12 to the print start position (S420).

Thereafter, when the preparing process that is started in 5330 has not been completed (S430: NO), the controller 130 waits for completion of the preparing process. After completion of the preparing process (S430: YES), the controller 130 sets "0" to the sheet type discriminability flag (S440).

Thereafter, similar to S150, the controller 130 executes the image recordation process (S450), and executes the sheet discharging process (S460) similar to S160. It is noted that the process in S450 is an example of a first recording process.

When it is determined that the state of the registration sensor 110 has not been changed from the off state to the on state (S410: NO), the controller 130 determines whether the feeding motor 102 has rotated by the particular amount (S510) as in S170.

When it is determined that that feeding motor 102 has rotated by the particular amount (S510: YES) while the state of the registration sensor 110 does not change from the off state to the on state (S410: NO), the controller 130 stops the feeding motor 102 and notifies that the sheet 12 cannot be fed (S520).

<Sheet Type Determining Process "B">

Hereinafter, referring to FIGS. 8A and 8B, the sheet type determining process "B" will be described. It is noted that the sheet type determining process "B" is a sheet type determining process to be executed when the plain sheet is designated as the recording sheet in the print setting.

When it is determined that recordation on the plain sheet is designated in the print setting, that is, when the controller 130 receives the second command (S190: NO), the controller 130 selects the glossy sheet non-feeding condition (S610) from among multiple feeding conditions stored in the ROM 132 or the EEPROM 134.

Next, the controller 130 detects absence/presence of the sheets 12 held by the feed tray 20 based on the signal transmitted from the optical sensor 117 of the sheet sensor 115 (S620).

When it is determined that the sheets 12 are held by the feed tray 20 (S620: YES), the controller 130 starts the preparing process (S630), and drives the feeding motor 102 (S640) in accordance with the glossy sheet non-feeding condition. It is noted that the preparing process is executed in parallel with the process in S640-S660.

When it is determined that no sheet 12 is held by the feed tray 20 (S620: NO), the controller 130 notifies that no sheet is held by the feed tray 20 (S710). Thereafter, when it is determined that the sheets 12 are held by the feed tray 20 (S720: YES), the controller 130 executes S630 and S640 described above.

When the feeding motor 102 is driven in S640, the feeding roller 25 rotates. Thereafter, the controller 130 determines, as is done in S120, whether the state of the registration sensor 110 has changed from the off state to the on state (S650).

When it is determined that the state of the registration sensor 110 has changed from the off sate to the on state (S650: YES) before the feeding motor 102 rotate by the particular amount (S730: NO), the controller 130 determines that the sheet 12 as fed is not the glossy sheet (i.e., the sheet 12 is the glossy sheet). In such a case, the controller 130 conveys the sheet 12 to the print start position (S660).

Thereafter, when the preparing process that is started in S630 has not been completed (S670: NO), the controller 130 waits for completion of the preparing process. After completion of the preparing process (S670: YES), the controller 130 sets "0" to the sheet type discriminability flag (S680).

Thereafter, similar to S150, the controller 130 executes the image recordation process (S690), and executes the sheet discharging process (S700) similar to S160. It is noted that the process in S690 is an example of a second recording process.

When it is determined that that feeding motor 102 has rotated by the particular amount (S730: YES) while the state of the registration sensor 110 does not change from the off state to the on state (S650: NO), the controller 130 determines whether the particular-amount rotation of the feeding motor 102 has been executed by a particular set times successively (S740).

When it is determined that the particular-amount rotation of the feeding motor 102 has not been executed by the particular set times successively (S740: NO), the controller 130 drives the feeding motor 102 in accordance with the glossy sheet non-feeding condition again (S640), and determines whether the state of the registration sensor 110 changes from the off state to the on state before the feeding motor 102 rotates by the particular rotation amount (S650, S730).

When it is determined that the particular-amount rotation of the feeding motor 102 has been executed by the particular set times successively (S740: YES) while the registration sensor 110 stays in the off state (S650: NO), the controller 130 determines that the sheets 12 set in the feed tray 20 are the glossy sheets. In such a case, the controller 130 stops the feeding motor 102 (S750), notifies that the plain sheet is not set to the feed tray 20 (S760), and terminates the sheet type determining process "B". Thus, when the state of the registration sensor 110 has not changed from the off state to the on state (S650: NO), image recordation on the sheets 12 set to the feed tray 20 is not executed.

According to the illustrative embodiment, when the particular-amount rotation of the feeding motor 102 is executed by particular set times successively while the state of the registration sensor 110 does not change from the off state to the on state, the controller 130 determines that the sheets 12 set in the feed tray 20 are the glossy sheets. The above configuration may be modified such that, when the particular-amount rotation of the feeding motor 102 is executed once, the controller 130 determines that the sheets 12 set in the feed tray 20 are the glossy sheets.

<Effects of Illustrative Embodiment>

According to the above-described illustrative embodiment, it is possible to determine whether the sheets 12 held by the feed tray 20 are the glossy sheets or the plain sheets depending on whether the registration sensor 110 and the controller 130 detect the sheet 12 until the feeding motor 102 rotates by the particular rotation amount.

Further, when the controller executes the first driving process (S340), the glossy sheet is not fed. It is noted that, after the glossy sheet has been fed and reached the conveying roller pair 59, it will be held and conveyed by the conveying roller pair 59 and the discharging roller pair 44. Therefore, there is a possibility that the surfaces of the sheet 12 may be scratched or damaged by the conveying roller pair 59 and the discharging roller pair 44. According to the illustrative embodiment, since the glossy sheet is not conveyed, scratches or damages on the surfaces of the glossy sheet due to unnecessary conveyance of the glossy sheet can be prevented.

According to the illustrative embodiment described above, the registration sensor 110 is arranged to contact the sheet 12 at an upstream position, in the conveying direction 15, with respect to the recorder assembly 24. Therefore, the type of the sheet 12 can be determined before the recorder assembly 24 starts recording an image onto the sheet 12.

Further, according to the illustrative embodiment, the first driving process (S340) is executed only when the feed tray 20 holds the sheets 12. Accordingly, when the feed tray 20 does not hold the sheets 12, and when it is not necessary to determine the type of the sheet 12, unnecessary execution of the first driving process can be avoided.

According to the illustrative embodiment, the type of the sheets 12 held by the feed tray 20 when moved from the detached position to the attached position is usually stored in the EEPROM 134 or the RAM 133. Thereafter, unless the feed tray 20 is moved to the detached position, the type of the sheets 12 held by the feed tray 20 will not change. According to the above-described embodiment, the first driving process (S340) is executed only when there is a possibility that the type of the sheets 12 held by the feed tray 20 is changed as the feed tray 20 is moved with respect to the MFP 10. Accordingly, when the feed tray 20 has not been moved and it is unnecessary to determine the type of the sheets 12, unnecessary execution of the first driving process can be avoided.

Further, when the rotation of the feeding roller 26 is being accelerated, a force caused by the acceleration is applied to the sheet 12, and the sheet 12 is fed by the feeding roller 25. According to the above-described embodiment, amount of rotation applied to the sheet 12 by the feeding roller 25 in accordance with the glossy sheet feeding condition (i.e., the second rotation amount) is greater than the rotation amount applied by the feeding roller 25 in accordance with the glossy sheet non-feeding condition (i.e., the first rotation amount). Therefore, feeding conditions can be set so that the glossy sheet that cannot be conveyed in accordance with the glossy sheet non-feeding condition can be conveyed in accordance with the glossy sheet feeding condition.

When the rotation speed of the feeding roller 25 is relatively slow, there is a possibility that the sheet 12 cannot be conveyed. According to the illustrative embodiment, the rotation speed of the feeding roller 25 according to the glossy sheet feeding condition (i.e., the second rotation speed) is greater than the rotation speed of the feeding roller 25 according to the glossy sheet non-feeding condition (i.e., the first rotation speed). Therefore, the feeding conditions can be set so that the glossy sheet, which may not be conveyed in accordance with the glossy sheet non-feeding condition, can be conveyed in accordance with the glossy sheet feeding condition.

According to the illustrative embodiment, determination whether the sheet 12 is fed by a plurality of times (S370). According to such a configuration, certainty of determination of the type of the sheets 12 held by the feed tray 20 can be improved.

According to the illustrative embodiment, by executing the notifying process (S500), it is ensured that the user recognizes that the sheets 12 held by the feed tray 20 are not the glossy sheets.

Further, since the glossy sheet is generally less easy to be fed by the feeding roller 25 than the plain sheet, it becomes easy to set the glossy sheet non-feeding condition.

According to the illustrative embodiment, the first driving process (S340) and the preparing process (S330) are executed in parallel, a time interval from the controller 130 receives the first command until the recorder assembly 24 starts executing the image recordation onto the sheet 12 can be shortened.

Further, according to the above-described embodiment, whether the sheets 12 held by the feed tray 20 are the glossy sheets or the plain sheets can be determined, and scratches and damages on the surface of the glossy sheet can be prevented in the sheet type determining process "B" as well as in the sheet type determining process "A".

<Modifications>

In the above-described embodiment, the feeding condition includes the maximum speed and the rotation amount of the feeding roller 25. Such a configuration can be modified, and the feeding condition may include parameters other than the maximum speed and the rotation amount of the feeding roller 25.

For example, the feeding condition may include the acceleration of the rotation speed of the feeding roller 25 (hereinafter, simply referred to as the acceleration of the feeding roller 25). In such a case, the acceleration in the glossy sheet feeding condition (which is an example of a second acceleration) is smaller than the acceleration in the glossy sheet non-feeding condition.

When the rotation speed of the feeding roller 25 is accelerated, a force caused by the acceleration is applied to the sheet 12, thereby the sheet 12 being fed by the feeding roller 25. In this case, if the acceleration of the feeding roller 25 is relatively large, the rotating feeding roller 25 may slip on the surface of the sheet 12. When the sheet 12 (e.g., the glossy sheet) is provided with a coating on its surface, a friction coefficient between the sheets is relatively high, and a sufficiently strong force is to be applied to the sheet 12 by the feeding roller 25. However, if the acceleration of the feeding roller 25 is high, the feeding roller 25 slips on the sheet before the force to press-contact the feeding roller 25 against the sheet 12 is generated. In such case, the sheet 12 cannot be fed.

According to the above-described modification, the acceleration of the feeding roller 25 in accordance with the glossy sheet feeding condition (i.e., a second acceleration) is smaller than the acceleration of the feeding roller 25 in accordance with the glossy sheet non-feeding condition (i.e., the first acceleration). According to this configuration, a possibility that the feeding roller 25 slips on the sheet 12 when driven in accordance with the glossy sheet feeding condition is smaller than that when the feeding roller 25 is driven in accordance with the glossy sheet non-feeding condition. Accordingly, it is possible to set the conditions so that the glossy sheets which cannot be fed in accordance with the glossy sheet non-feeding condition can be fed in accordance with the glossy sheet feeding condition.

It is noted that the feeding condition may be a period during which the rotation speed of the feeding roller 25 is increasing (hereinafter, such a period will be referred to an acceleration period). In this case, the acceleration period when the feeding roller 25 is driven in accordance with the glossy sheet feeding condition (an example of a second period) is longer than the acceleration period when the feeding roller 25 is driven in accordance with the glossy sheet non-feeding condition (an example of a first period).

When the rotation speed of the feeding roller 25 is accelerated, a force caused by the acceleration is applied to the sheet 12, thereby the sheet 12 being fed by the feeding roller 25. According to the above-described modification, a period during which the force is applied to the sheet 12 when the feeding roller 25 is driven in accordance with the glossy sheet feeding condition (i.e., the second period) is longer than that when the feeding roller 25 is driven in accordance with the glossy sheet non-feeding condition (i.e., the first period). Accordingly, it is possible to set the conditions so that the glossy sheets which cannot be fed in accordance with the glossy sheet non-feeding condition can be fed in accordance with the glossy sheet feeding condition.

When the feeding condition is defined by the acceleration, it is not necessary that the rotation amount according to the glossy sheet non-feeding condition is smaller than the rotation amount according to the glossy sheet feeding condition, the maximum speed according to the glossy sheet non-feeding condition is smaller than the maximum speed according to the glossy sheet feeding condition, or the acceleration period according to the glossy sheet feeding condition is longer than the acceleration period according to the glossy sheet non-feeding condition.

When the feeding condition is defined by the acceleration period, the rotation amount according to the glossy sheet non-feeding condition is smaller than the rotation amount according to the glossy sheet feeding condition, the maximum speed according to the glossy sheet non-feeding condition is smaller than the maximum speed according to the glossy sheet feeding condition, or the acceleration according to the glossy sheet non-feeding condition is smaller than the acceleration according to the glossy sheet feeding condition.

According to the illustrative embodiment and modification, the feeding conditions are set so that the glossy sheet and the plain sheet are discriminated. Optionally or alternatively, the feeding condition can be set so that other sheets can be discriminated. For example, feeding condition may be set so that a post card cannot be fed but only the plain sheet can be fed so that the types of the sheets can be discriminated.

According to the illustrative embodiment, the glossy sheet is fed in S400 and the image recording process is applied to the fed sheet (the second driving process). The above configuration may be modified such that the second driving process is executed twice in S400. That is, the glossy sheet fed in the first execution of the second driving process is discharged, another glossy sheet is fed in the second execution of the second driving process, and the image recording process is applied to the sheet fed in the second execution of the second driving process.

According to the illustrative embodiment, feeding of the sheet 12 is defined as a movement of the sheet 12, caused by the feeding roller, until the sheet 12 reaches the registration sensor 110. Thus, the glossy sheet non-feeding condition is a feeding condition according to which the glossy sheet 12 does not reach the position of the registration sensor 110. When the glossy sheet is held by the feed tray 20, the glossy sheet is fed by the feeding roller 25 according to the first driving process. However, there could be a case where the fed glossy sheet stops before it reaches the registration sensor 100. In such a case, as the sheet 12 is fed according to the second driving process, the feeding amount cannot be set correctly.

Therefore, the glossy sheet which was fed by the first execution of the second driving process but stopped midway may be discharged, and another glossy sheet may be fed by the second execution of the second driving process. It is noted that, when the glossy sheet held by the feed tray 20 has not been fed in the first driving process, the glossy sheet held by the feed tray 20 is fed and discharged in the second execution of the second driving process.

What is claimed is:

1. An image recording apparatus, comprising:

a tray configured to support one or more sheets;

a motor configured to generate a driving force;

a feeding roller configured to feed the sheet held by the tray, as the driving force is transmitted from the motor, toward a conveying passage through which the sheet is fed;

a first sensor configured to detect the sheet passing through the conveying passage;

a recorder configured to record an image on the sheet passing through the conveying passage; and a controller, wherein the controller is configured to:

in response to receipt a first command designating recordation of an image on a first type sheet, drive the motor in accordance with a first feeding condition according to which the feeding roller cannot feed the first type sheet but can feed a second type sheet which is different from the first type sheet;

in response to the first sensor not detecting the sheet from a start of driving of the motor in accordance with the first feeding condition until the motor rotates by a particular rotation amount, drive the motor in accordance with a second feeding condition according to which the feeding roller can feed the first type sheet and cause the recorder to record an image, based on the first command, on the sheet which is fed as the motor is driven in accordance with the second feed condition; and in response to the first sensor detecting the sheet from the start of driving of the motor in accordance with the first feeding condition before the motor rotates by the particular rotation amount, not record the image, based on the first command, on the sheet which is fed as the motor is driven in accordance with the first feeding condition.

2. The image recording apparatus according to claim 1, wherein the first sensor is configured to detect the sheet located on an upstream side, in a conveying direction of the sheet fed by the feeding roller, with respect to the recorder.

3. The image recording apparatus according to claim 2, wherein the first sensor is positioned on the upstream side with respect to the recorder in the conveying direction.

4. The image recording apparatus according to claim 1, further comprising a second sensor configured to detect presence/absence of the sheet held by the tray, wherein the controller drives the motor in accordance with the first feeding condition in response to receipt of the first command and determination that the sheet is held by the tray based on a detection result of the second sensor.

5. The image recording apparatus according to claim 1, wherein the tray is configured to be movable to an attached position at which the sheet held by the tray can be fed toward the conveying passage and to a detached position which is different from the attached position, the image recording apparatus comprises a third sensor configured to detect a position of the tray, and wherein the controller drives the motor in accordance with the first feeding condition in response to receipt of the first command and determination that the tray has been moved from the detached position to the attached position based on a detection result of the third sensor.

6. The image recording apparatus according to claim 1, wherein the first feeding condition includes a condition to rotate the feeding roller in accordance with a first rotation acceleration, and wherein the second feeding condition includes a condition to rotate the feeding roller in accordance with a second rotation acceleration which is smaller than the first rotation acceleration.

7. The image recording apparatus according to claim 1, wherein the first feeding condition is a condition to accelerate the rotation speed of the feeding roller for a first period of time, and wherein second feeding condition is a condition to accelerate the rotation speed of the feeding roller for a second period which is longer than the first period.

8. The image recording apparatus according to claim 1, wherein the first feeding condition is a condition causing the feeding roller to reach a first rotation speed while the feeding roller rotates by a first rotation amount, wherein the second feeding condition is a condition causing the feeding roller to reach a second rotation speed while the feeding roller rotates by a second rotation amount, wherein the first rotation amount is smaller than the second rotation amount, and wherein the first rotation speed is smaller than the second rotation speed.

9. The image recording apparatus according to claim 1, wherein, in response to the first sensor not detecting the sheet by a plurality of times successively while executing rotation of the motor by the particular amount, the controller executes a second driving process.

10. The image recording apparatus according to claim 1, wherein, in response to the first sensor not detecting the sheet from start of a first driving process until the motor rotates by the particular rotation amount, the controller notifies that the tray does not hold the first type sheets.

11. The image recording apparatus according to claim 1, wherein the first type sheets are glossy sheets, and wherein the second type sheets are plain sheets.

12. The image recording apparatus according to claim 1, wherein, in response to receipt of the first command, the controller executes a preparation process to be executed before causing the recorder to record the image while driving the motor in accordance with the first feeding condition.

13. The image recording apparatus according to claim 1, wherein the controller drives the motor in accordance with the first feeding condition in response to receipt of a second command instructing recordation of an image on the second type sheet, and wherein:

in response to the first sensor detecting the sheet after the controller starts rotating the motor and before the motor rotates by the particular rotation amount, the controller causes the recorder to record the image on the sheet in accordance with the second command; and in response to the first sensor not detecting the sheet after the controller starts rotating the motor and before the motor rotates by the particular rotation amount, the controller does not cause the recorder to record the image on the sheet in accordance with the second command.

14. An image recording method employed in an image recording apparatus having a tray configured to support one of more sheets, a motor configured to generate a driving force, a feeding roller configured to feed the sheet held by the tray, as the driving force is transmitted from the motor, toward a conveying passage through which the sheet is fed a first sensor configured to detect the sheet passing through the conveying passage, a recorder configured to record an image on the sheet passing through the conveying passage, wherein the method comprising:

in response to receipt a first command designating recordation of an image on a first type sheet, driving the motor in accordance with a first feeding condition according to which the feeding roller cannot feed the first type sheet but can feed a second type sheet which is different from the first type sheet;

in response to the first sensor not detecting the sheet from a start of driving of the motor in accordance with the first feeding condition until the motor rotates by a particular rotation amount, driving the motor in accordance with a second feeding condition according to which the feeding roller can feed the first type sheet and causing the recorder to record an image, based on the first command, on the sheet which is fed as the motor is driven in accordance with the second feed condition; and in response to the first sensor detecting the sheet from the start of driving of the motor in accordance with the first feeding condition before the motor rotates by the particular rotation amount, not recording the image, based on the first command, on the sheet which is fed as the motor is driven in accordance with the first feeding condition.

* * * * *